US008169143B2

(12) United States Patent
Okui et al.

(10) Patent No.: US 8,169,143 B2
(45) Date of Patent: May 1, 2012

(54) PLASMA DISPLAY PANEL HAVING ELECTRON EMITTING MATERIAL

(75) Inventors: Yayoi Okui, Osaka (JP); Osamu Inoue, Osaka (JP); Kojiro Okuyama, Nara (JP); Seigo Shiraishi, Osaka (JP)

(73) Assignee: Panasonic Corporation, Osaka (JP)

( * ) Notice: Subject to any disclaimer, the term of this patent is extended or adjusted under 35 U.S.C. 154(b) by 137 days.

(21) Appl. No.: 12/678,412

(22) PCT Filed: Jul. 22, 2009

(86) PCT No.: PCT/JP2009/003446

§ 371 (c)(1),
(2), (4) Date: Mar. 16, 2010

(87) PCT Pub. No.: WO2010/010698

PCT Pub. Date: Jan. 28, 2010

(65) Prior Publication Data

US 2010/0259158 A1 Oct. 14, 2010

(30) Foreign Application Priority Data

Jul. 25, 2008 (JP) ..... 2008-192602

(51) Int. Cl.
*H01J 17/49* (2006.01)

(52) U.S. Cl. ..... 313/587; 313/582

(58) Field of Classification Search ..... 313/587, 313/582

See application file for complete search history.

(56) References Cited

U.S. PATENT DOCUMENTS

| | | | | |
|---|---|---|---|---|
| 4,198,585 | A | 4/1980 | Yamashita et al. | |
| 6,774,558 | B2 | 8/2004 | Otani et al. | |
| 2007/0152593 | A1 * | 7/2007 | Kim et al. | 313/587 |

FOREIGN PATENT DOCUMENTS

| | | | |
|---|---|---|---|
| JP | 52-063663 | A | 5/1977 |
| JP | 2003-016949 | A | 1/2003 |
| JP | 2004-273158 | A | 9/2004 |
| JP | 2007-095436 | A | 4/2007 |

* cited by examiner

*Primary Examiner* — Mariceli Santiago
*Assistant Examiner* — Glenn D Zimmerman
(74) *Attorney, Agent, or Firm* — Hamre, Schumann, Mueller & Larson, P.C.

(57) ABSTRACT

A plasma display panel (200) of the present invention includes a first panel (1) and a second panel (8). A discharge space (14) is formed between the first panel (1) and the second panel (8). In the plasma display panel (200), an electron emitting material (20) is disposed to face the discharge space (14). The electron emitting material (20) contains Sn, an alkali metal, O (oxygen), and at least one element selected from the group consisting of Ca, Sr, and Ba.

7 Claims, 4 Drawing Sheets

PLASMA DISPLAY PANEL HAVING ELECTRON EMITTING MATERIAL

TECHNICAL FIELD

The present invention relates to plasma display panels.

BACKGROUND ART

Plasma display panels (hereinafter referred to as PDPs), which are one type of flat panel display, have been developed for practical use and have spread rapidly because of their advantages such as easy upsizing, high-speed display, and low cost.

A commercially available common PDP has a structure in which two glass substrates facing each other, which serve as a front substrate and a rear substrate, each have regularly arranged electrodes and a dielectric layer made of low-melting glass or the like to cover these electrodes. On the dielectric layer of the rear substrate, phosphor layers are provided. On the dielectric layer of the front substrate, a MgO layer as a protective layer is provided to protect the dielectric layer from ion bombardment and to cause secondary electrons to be emitted. A gas containing an inert gas such as Ne or Xe as a main component is sealed into the space between the two substrates and a voltage is applied between the electrodes to generate a discharge, thus causing the phosphors to emit light so that an image is displayed.

There has been a strong demand for high efficiency PDPs. In order to meet this demand, there have been known a method of reducing the dielectric constant of a dielectric layer and a method of increasing the partial pressure of Xe in a discharge gas. The use of these methods, however, causes a problem that a firing potential and a sustaining voltage increase.

It has been known that if a protective layer is made of a material having a high secondary electron emission coefficient, the firing potential and sustaining voltage can be reduced. In this case, a high efficiency PDP can be obtained at low cost because elements having low withstand voltages can be used. For this purpose, it has been considered to use CaO, SrO or BaO, or a solid solution of these oxides instead of MgO, because each of these oxides has a higher secondary electron emission coefficient than MgO even though it also is an alkaline earth metal oxide (Patent Literatures 1 and 2).

CITATION LIST

Patent Literature

Patent Literature 1: JP 52 (1977)-63663 A
Patent Literature 2: JP 2007-95436 A

SUMMARY OF INVENTION

Technical Problem

Since CaO, SrO and BaO are, however, chemically unstable compared with MgO, they react easily with moisture and carbon dioxide in the air to form hydroxides and carbonates respectively. When these hydroxides and carbonates are formed, the following problems occur. That is, the secondary electron emission coefficient decreases and the voltages cannot be reduced as expected, or the aging process of the resulting PDP, which is considered necessary to reduce the voltages, takes a very long time and its practicality is reduced.

Such a deterioration caused by a chemical reaction can be avoided by, for example, controlling the atmospheric gas used in the manufacturing process, if a small number of PDPs are produced in a laboratory. It is, however, difficult to control the atmosphere throughout the production processes in a factory, and the production cost would increase, even if possible. Therefore, only MgO has still been used practically even though the use of materials having higher secondary electron emission coefficients has been considered conventionally. As a result, a sufficiently high efficiency PDP driven at a sufficiently low voltage has not yet been obtained.

Accordingly, it is an object of the present invention to provide a PDP having a low driving voltage by improving the discharge characteristics of the PDP by using an electron emitting material having an excellent chemical stability and a high secondary electron emission coefficient.

Solution of Problem

The present invention provides a PDP including a first panel and a second panel with a discharge space being formed between the first panel and the second panel. In this PDP, an electron emitting material is disposed to face the discharge space, and the electron emitting material contains Sn, an alkali metal, O (oxygen), and at least one element selected from the group consisting of Ca, Sr, and Ba.

Advantageous Effects of Invention

According to the present invention, it is possible to provide a PDP having a low driving voltage by using a chemically stable electron emitting material having a high secondary electron emission coefficient.

DESCRIPTION OF EMBODIMENT

Figure 1:
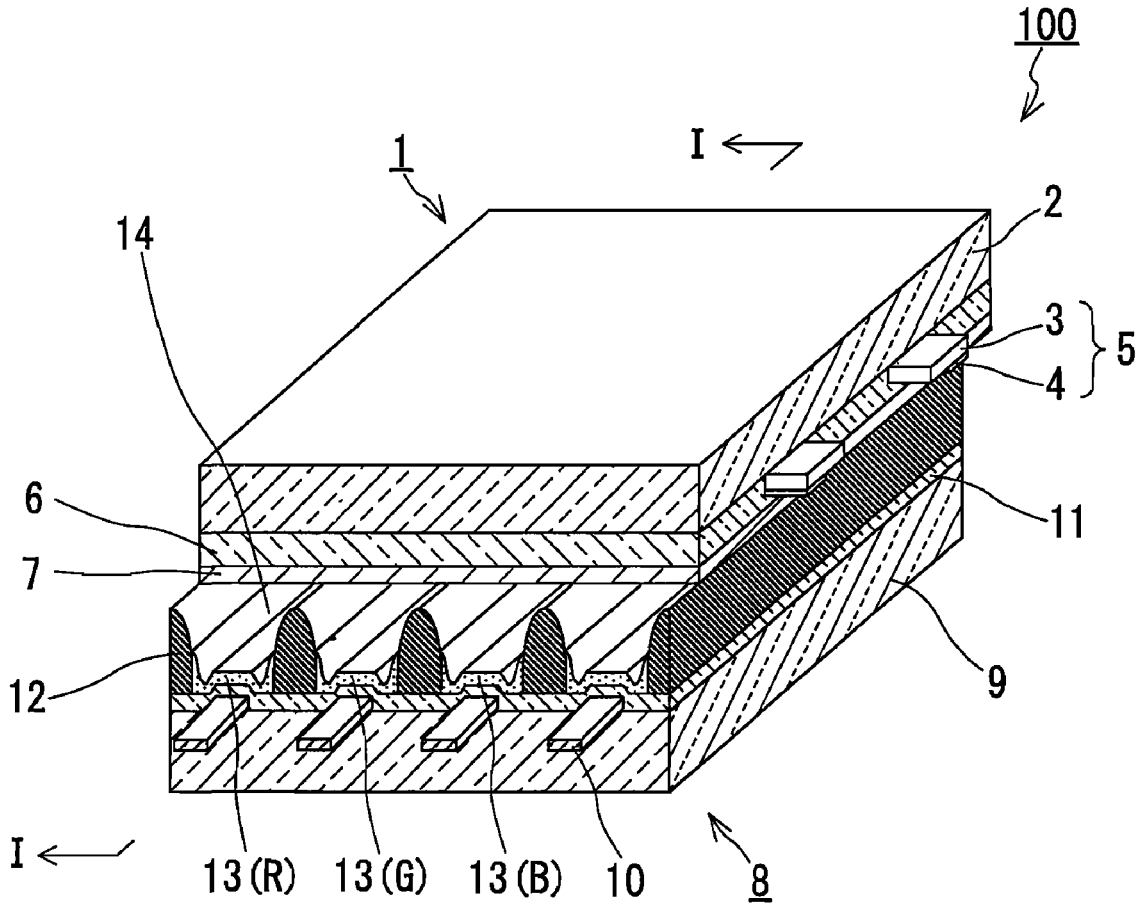
FIG. 1 is an exploded perspective diagram for explaining an example of a PDP of the present invention.

As a result of detailed studies, the present inventors have found that a material containing Sn, an alkali metal, O, and at least one element selected from the group consisting of Ca, Sr, and Ba, that is, a material obtained by reacting $SnO_2$ and an alkali metal with CaO, SrO, and/or BaO, has an excellent chemical stability and has a higher secondary electron emission coefficient than that of MgO that has been used conventionally as an electron emitting material, even though CaO, SrO and BaO themselves are chemically unstable even though they have high secondary electron emission coefficients. As a result, the present inventors have found that the use of such a material as an electron emitting material of a PDP allows the driving voltage of the PDP to be reduced compared with the use of conventional MgO.

A compound produced by combining chemically unstable CaO, SrO, and/or BaO with $SnO_2$ overcomes the chemical instability of CaO, SrO, and BaO effectively, and particularly inhibits the hydroxylation thereof effectively. The further addition of an alkali metal to such a material containing $SnO_2$ and CaO, SrO, and/or BaO particularly inhibits the carbonation of CaO, SrO, and BaO effectively. As described above, an electron emitting material having a high secondary electron emission coefficient and an excellent chemical stability with inhibited hydroxylation and carbonation can be obtained by combining Sn, an alkali metal, O, with at least one element selected from the group consisting of Ca, Sr, and Ba. Such a material has high electron emission performance and the electron emission performance does not degrade easily. Therefore, when such a material is used as an electron emitting material of a PDP, the PDP has a low driving voltage and has a good stability.

In order to achieve more reliably the excellent chemical stability and the higher secondary electron emission coefficient than that of MgO that has been used conventionally as an electron emitting material, it is preferable that the electron emitting material used in the present invention contains, as a main component, Sn, an alkali metal, O, and at least one element selected from the group consisting of Ca, Sr, and Ba. As used herein, the phrase "the electron emitting material contains, as a main component, Sn, an alkali metal, O, and at least one element selected from the group consisting of Ca, Sr, and Ba" means that the total content of Sn, the alkali metal, and at least one element selected from the group consisting of Ca, Sr, and Ba is at least 60 atomic %, preferably at least 90 atomic %, relative to the total content of cations in the electron emitting material, although the preferable content of these elements cannot be determined definitely because it depends on the properties of the other elements.

The structure of the electron emitting material used in the present invention is not particularly limited as long as it is a material containing Sn, an alkali metal, O, and at least one element selected from the group consisting of Ca, Sr, and Ba. For example, it may have a crystalline structure, or may be in an amorphous state. The electron emitting material may be a compound in which Ca, Sr, and/or Ba, or Sn are substituted partially with other elements. In this case, it is preferable that the amount of partially-substituted elements is within the range satisfying the above-mentioned total content of Sn, an alkali metal, O, and Ca, Sr, and/or Ba. Further preferably, the amount of partially-substituted elements is within a reasonable range in which the properties required for the electron emitting material used in the present invention (i.e., the properties of chemical stability and high second electron emission efficiency) are not impaired essentially.

In order to obtain more reliably the properties required for the electron emitting material used in the present invention, it is desirable that the electron emitting material used in the present invention consist essentially of Sn, an alkali metal, O, and at least one element selected from the group consisting of Ca, Sr, and/or Ba. As used herein, the phrase "the electron emitting material consists of Sn, an alkali metal, O, and at least one element selected from the group consisting of Ca, Sr, and Ba" means that the electron emitting material contains no other elements, or even if it contains other elements, the content of the elements is as low as that of inevitably contained impurities.

Preferably, the electron emitting material used in the present invention is a material represented by the general formula $a(M^1O).SnO_2.b(M^2O_{0.5})$ to achieve a higher chemical stability. As described above, the structure of the electron emitting material is not particularly limited, but it is desirably a crystalline compound because the crystalline compound exhibits a high chemical stability. In the above general formula, $M^1$ is at least one element selected from the group consisting of Ca, Sr, and Ba, and $M^2$ is at least one element selected from the group consisting of Li, Na, K, Rb, and Cs. The value of a is in the range of 1 or more to 2 or less, and the value of b is in the range of 0.002 or more to 0.3 or less. Hereinafter, the letters $M^1$, $M^2$, a, and b are used in the same sense as described above.

As to the secondary electron emission coefficient, a material containing SrO has a higher coefficient than that containing CaO, and further a material containing BaO has a still higher coefficient than that containing SrO. On the other hand, as to the chemical stability, a material containing SrO has a higher stability than that containing BaO, and further a material containing CaO has a still higher stability than that containing SrO.

Examples of the method of synthesizing an electron emitting material containing Sn, an alkali metal, O, and at least one element selected from Ca, Sr, and Ba include a solid phase method, a liquid phase method, and a vapor phase method.

A solid phase method is a method in which powdered raw materials containing the above-mentioned metal elements (such as metal oxides and metal carbonates) are mixed and the mixture is subjected to heat treatment at a certain temperature or higher for the reaction thereof.

A liquid phase method is a method in which a solution containing the above-mentioned metal elements is prepared and a solid phase precipitated from the solution is obtained or the solution is applied to a substrate, dried, and then subjected to heat treatment or the like at a certain temperature or higher to obtain a solid phase.

A vapor phase method is a method of obtaining a solid-phase film by a technique such as vapor deposition, sputtering, or CVD. In the vapor phase method, not only a crystalline oxide containing Sn, an alkali metal, and Ca, Sr, and/or Ba at a specific ratio, but also an amorphous compound containing Sn, an alkali metal, O, and Ca, Sr, and/or Ba can be obtained. Such an amorphous compound also is more chemically stable than CaO, SrO, or BaO, and has a higher secondary electron emission coefficient than MgO. Therefore, the use of such an amorphous compound reduces the driving voltage of the PDP.

A crystalline material has, however, has a higher chemical stability than an amorphous material. In addition, the vapor phase method used as a synthesis method to obtain an amorphous compound costs more than the solid phase method or the like. Therefore, the electron emitting material used in the present invention preferably is a crystalline compound.

In the PDP of the present invention, the electron emitting material is disposed to face the discharge space. For example, the electron emitting material can be disposed on at least one panel selected from the first panel and the second panel of the PDP so as to face the discharge space. Generally, any of these electron emitting materials may be formed on the dielectric layer covering the electrodes on the front panel. The electron emitting material also may be formed on another portion of the PDP, for example, on the phosphor or the surface of the barrier rib as long as the portion faces the discharge space. In this case, a greater effect of driving voltage reduction is seen than the case where no electron emitting material is formed.

Next, examples of the form of the electron emitting material provided in the PDP will be described. The electron emitting material can be disposed in at least one form selected from particles and a film. For example, in the case where the electron emitting material is formed on the dielectric layer (first dielectric layer) covering the electrodes on the front panel (first panel), the following methods can be used: a method in which a film of the electron emitting material is formed or a powder of the electron emitting material is spread on the dielectric layer instead of forming a conventional MgO film as a protective layer on the dielectric layer; and a method in which a MgO film is formed and then a film of the electron emitting material is formed or a powder of the electron emitting material is spread on the MgO film. When the electron emitting material is used in the form of powder, the particle diameter may be selected from the range of approximately 0.1 to 10 μm according to the cell size or the like.

In the present description, as an example of the electron emitting material, a material represented by $a(M^1O).SnO_2.b(M^2O_{0.5})$ is given. Sn is an element that is converted to $Sn^{4+}$ easily. A part of Sn, however, is converted to $Sn^{2+}$ easily. In this case, an oxygen vacancy occurs. Therefore, the electron emitting material should be represented by $a(M^1O).SnO_{2-}\delta.b(M^2O_{0.5})$ more accurately. However, the value of δ is not constant because it varies depending on the production conditions, etc. Therefore, the electron emitting material herein is represented by $a(M^1O).SnO_2.b(M^2O_{0.5})$, which is not meant to preclude the presence of oxygen vacancy. That is, materials represented by $a(M^1O).SnO_2.b(M^2O_{0.5})$ include a compound in which an oxygen vacancy occurs. The oxygen vacancy occurring inevitably during the production process does not have a particularly significant effect on the properties of the electron emitting material used in the present invention.

Tetravalent Sn can be substituted partially with another tetravalent element such as Ti or Zr, a trivalent In, a pentavalent Nb, or the like. Each of divalent Ca, Sr, and Ba also can be substituted partially with another divalent element such as Mg, a trivalent La, or the like. As described above, the above-mentioned elements contained in the electron emitting material used in the present invention may be substituted slightly as long as the material contains Sn, an alkali metal, O, and at least one element selected from the group consisting of Ca, Sr, and Ba (preferably, the material contains these elements as a main component).

Figure 2:
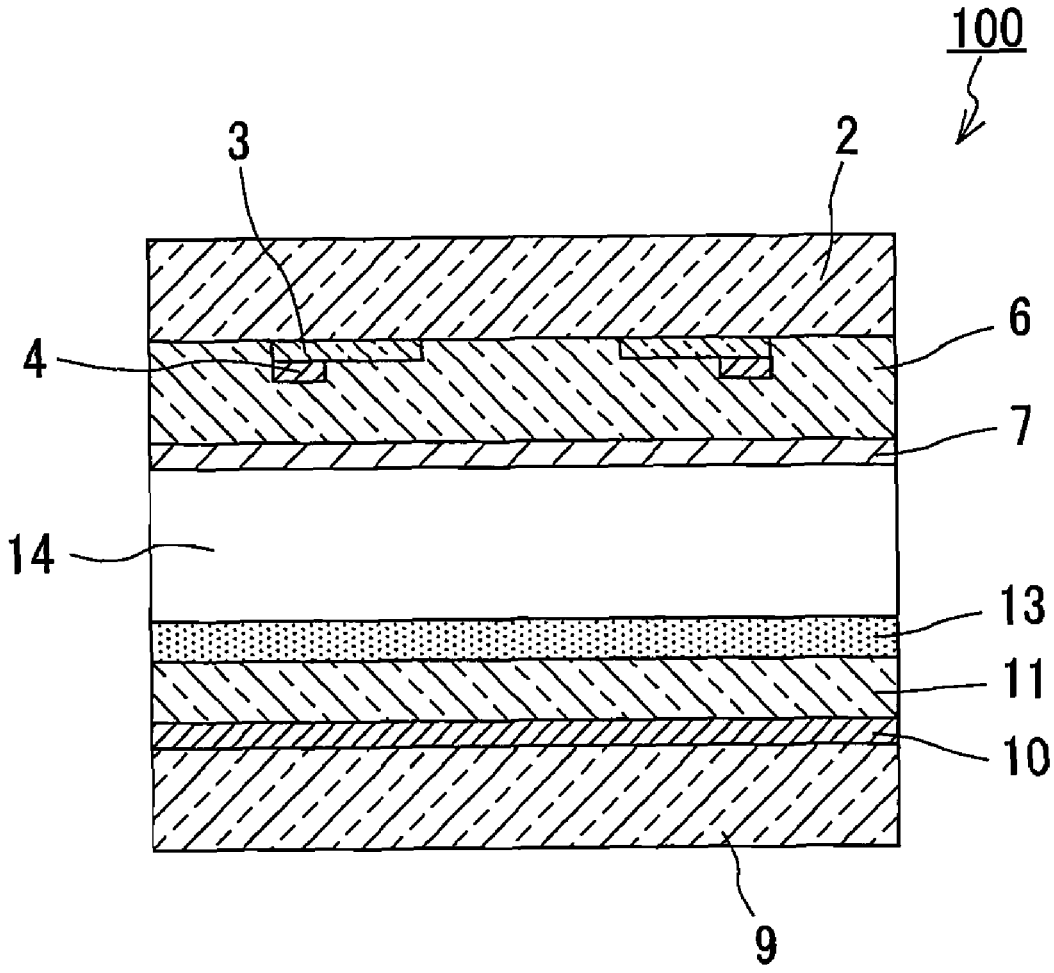
FIG. 2 is a longitudinal sectional view of the PDP shown in FIG. 1.

Next, specific examples of the PDP of the present invention will be described with reference to the accompanying drawings. FIG. 1 and FIG. 2 each illustrate an example of the PDP according to the present invention. FIG. 1 is an exploded perspective view of a PDP 100. FIG. 2 is a longitudinal sectional view of the PDP 100 (i.e., a cross-sectional view taken along a line I-I in FIG. 1). As shown in FIGS. 1 and 2, the PDP 100 has a front panel (first panel) 1 and a rear panel (second panel) 8. Discharge spaces 14 are formed between the front panel 1 and the rear panel 8. This PDP 100 is of an AC plane discharge type and has the same configuration as that of a conventional PDP except that a protective layer 7 is formed of the above-mentioned compound.

The front panel 1 includes: a front glass substrate (first substrate) 2; display electrodes (first electrodes) 5, each of which is composed of a transparent conductive film 3 and a bus electrode 4, and is formed on the inner surface (the surface facing the discharge space 14) of the front glass substrate 2; a dielectric layer (first dielectric layer) 6 formed to cover the display electrodes 5; and a protective layer 7 formed on the dielectric layer 6. The display electrodes 5 each are formed with the bus electrode 4 made of, for example, Ag, being stacked on the transparent conductive film 3 made of ITO or tin oxide in order to ensure good conductivity.

The rear panel 8 includes: a rear glass substrate (second substrate)$_9$; address electrodes (second electrodes) 10 formed on one surface of the rear glass substrate 9; a dielectric layer (second dielectric layer) 11 formed to cover the address electrodes 10; barrier ribs 12 provided on the upper surface of the dielectric layer 11; and phosphor layers formed between the adjacent barrier ribs 12. The phosphor layers are formed so that a red phosphor layer 13(R), a green phosphor layer 13(G), and a blue phosphor layer 13(B) are arranged in this order.

For the phosphors that constitute the phosphor layers, $BaMgAl_{10}O_{17}$:Eu can be used as a blue phosphor, $Zn_2SiO_4$:Mn can be used as a green phosphor, and $Y_2O_3$:Eu can be used as a red phosphor, for example.

The front panel 1 and the rear panel 8 are disposed so that the display electrodes 5 and the address electrodes 10 are orthogonal to each other in their longitudinal directions and they oppose each other, and are joined with a sealing member (not shown).

A discharge gas composed of a rare gas such as He, Xe or Ne is sealed in the discharge space 14.

The display electrodes 5 and the address electrodes 10 each are connected to an external drive circuit (not shown). When a voltage is applied from the drive circuit, a discharge is generated in the discharge space 14, and ultraviolet rays with a short wavelength (a wavelength of 147 nm) are generated by the discharge. The phosphor layers 13 are excited by the ultraviolet rays to emit visible light. The above-mentioned electron emitting material is used for the protective layer 7.

Figure 3:
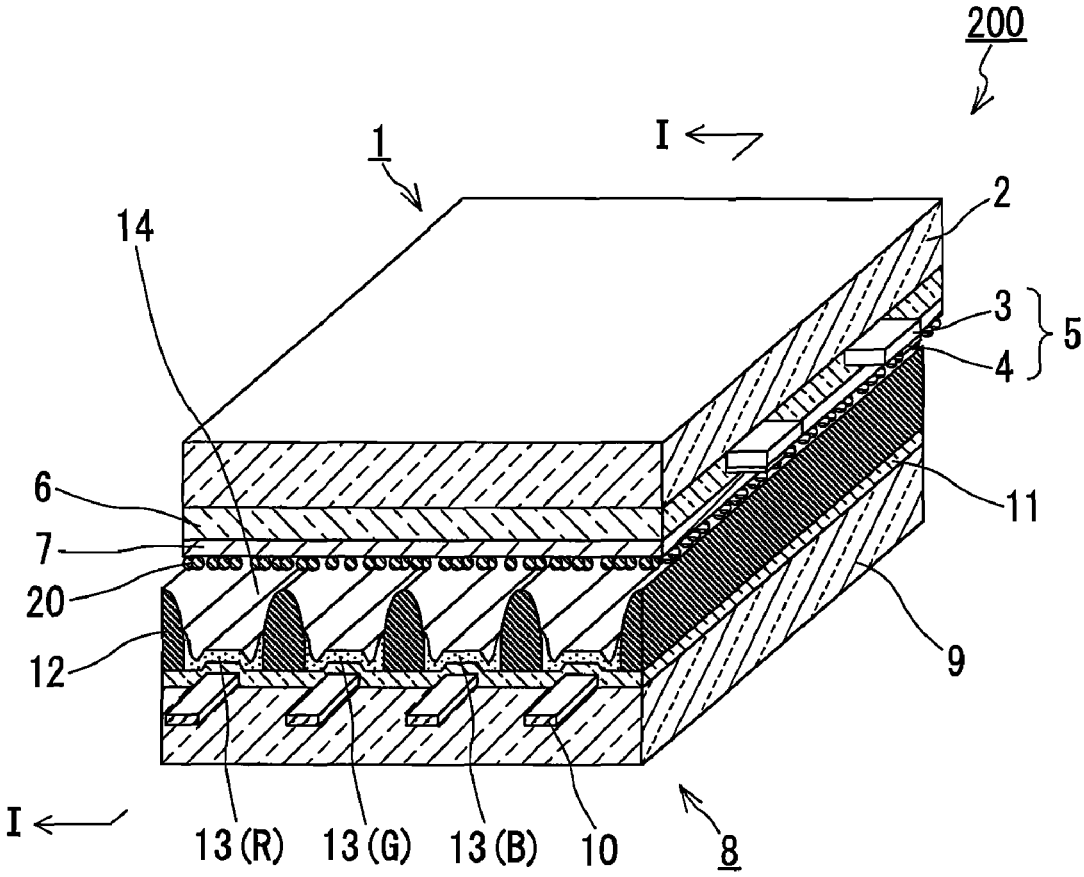
FIG. 3 is an exploded perspective diagram for explaining another example of a PDP of the present invention.
Figure 4:
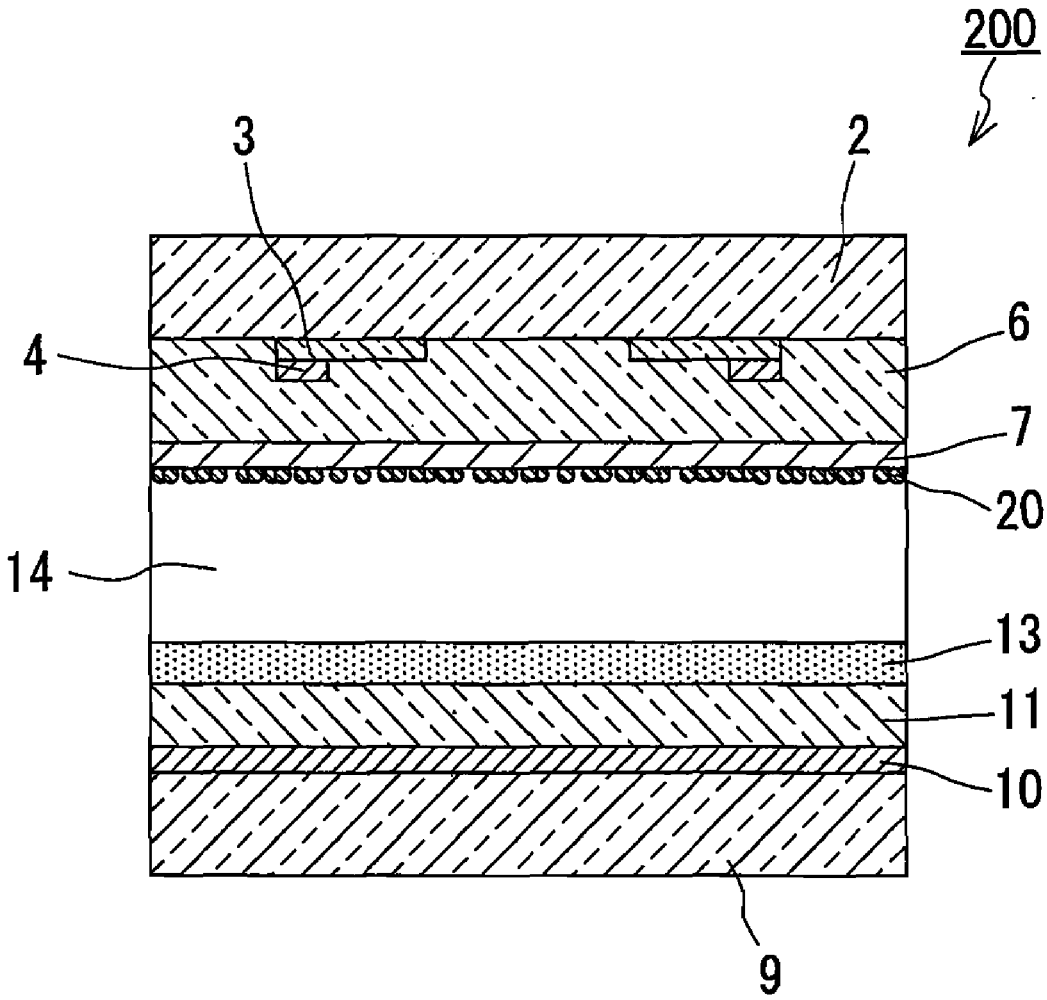
FIG. 4 is a longitudinal sectional view of the PDP shown in FIG. 3.

FIG. 3 and FIG. 4 each illustrate another example of the PDP according to the present invention. FIG. 3 is an exploded perspective view of the PDP 200. FIG. 4 is a longitudinal sectional view of the PDP 200 (i.e., a cross-sectional view taken along a line I-I in FIG. 3). The PDP 200 has the same configuration as that of the PDP 100 except that the protective layer 7 is made of MgO and the above-mentioned electron emitting material 20 is provided in the form of particles on the protective layer 7. Also in the PDP 200, the electron emitting material 20 is disposed to face the discharge space 14.

Next, a method of manufacturing the PDP 200 by spreading a powder of the above-mentioned electron emitting material on the protective layer 7 made of a conventional MgO film will be described using an example. First, the front panel 1 is produced. A plurality of linear transparent electrodes 3 are formed on one principal surface of the flat front glass substrate 2. Subsequently, a silver paste is applied onto the transparent electrodes and then is baked by heating the whole front glass substrate 1, and thereby bus electrodes 4 are formed. As a result, the display electrodes 5 are formed.

A glass paste containing glass for the dielectric layer 6 of the PDP 200 of the present embodiment is applied to the above-mentioned principal surface of the front glass substrate 2 by the blade coater method so as to cover the display electrodes 5. Thereafter, the whole front glass substrate 2 is maintained at 90° C. for 30 minutes and thereby the glass paste is dried. Subsequently, it is baked at a temperature of around 580° C. for 10 minutes.

A film of magnesium oxide (MgO) is formed on the dielectric layer 6 by an electron beam vapor deposition method and then is baked at a temperature around 500° C. Thus, the protective layer 7 is formed.

A paste is prepared by mixing a vehicle such as ethyl cellulose with the powdery electron emitting material used in the present invention. The paste is applied to the protective layer 7 by a printing method or the like, dried, and then baked at a temperature around 500° C. Thus, a layer in which the particles of the electron emitting material 20 are spread is formed.

Next, the rear panel 8 is produced. After a silver paste is applied to one principal surface of the flat rear glass substrate 9 in the form of a plurality of lines, the whole rear glass substrate 9 is heated and thereby the silver paste is baked. Thus the address electrodes 10 are formed.

A glass paste is applied between adjacent address electrodes 10, and the glass paste is baked by heating the whole rear glass substrate 9. Thus, barrier ribs 12 are formed.

Phosphor inks with respective R, G, and B colors are applied between adjacent barrier ribs 12, the above-mentioned phosphor inks are baked by heating the rear glass substrate 9 at 500° C., and thereby a resin component (binder) in the phosphor inks is removed. Thus, phosphor layers are formed.

The front panel 1 and the rear panel 8 thus obtained are bonded to each other using sealing glass at a temperature around 500° C. Then, the sealed inner space is subjected to high vacuum evacuation, and then rare gas is sealed therein.

PDP 200 is obtained as described above.

The above-mentioned PDP and the method of producing it are examples and the present invention is not limited thereto.

In the case where the protective layer 7 is formed by providing the above-mentioned electron emitting material used in the present invention as a thin film instead of forming the protective layer 7 made of a MgO film, a conventional thin film formation technique such as electron beam vapor deposition may be used as in the case of the MgO film. Another method may be used. A paste having a high content of the powdery electron emitting material is prepared by mixing the powdery material with a vehicle, a solvent, or the like. A thin coating of this paste is applied by a printing method or the like, and then baked to obtain a thin film or a thick film.

On the other hand, in the case where the powdery electron emitting material is spread, a paste having a relatively low content of the powdery material may be spread by a printing method, a solvent in which the powdery material is dispersed may be spread, or a spin coater method may be used.

EXAMPLES

Hereinafter, the present invention is described further in detail with reference to Examples.

[Electron Emitting Materials]

In the examples below, the effect of reducing the carbonate formation of the following materials is described: an electron emitting material synthesized by reacting $CaCO_3$ with $SnO_2$ and $K_2CO_3$ by the solid phase method; an electron emitting material synthesized by reacting $SrCO_3$ with $SnO_2$, and $Li_2CO_3$, $Na_2CO_3$, or $K_2CO_3$ by the solid phase method; and an electron emitting material synthesized by reacting $BaCO_3$ with $SnO_2$, and $Li_2CO_3$, $Na_2CO_3$, $K_2CO_3$, $Rb_2CO_3$, or $Cs_2CO_3$ by the solid phase powder method.

As starting materials, $CaCO_3$, $SrCO_3$, $BaCO_3$, $SnO_2$, $Li_2CO_3$, $Na_2CO_3$, $K_2CO_3$, $Rb_2CO_3$, and $Cs_2CO_3$ of at least special grade reagents were used. These materials were weighed according to the molar ratios of respective metal ions shown in Table 1, wet-mixed in a ball mill, and then dried. Thus, respective powder mixtures were obtained.

These powder mixtures each were put into a platinum crucible, and fired in air in an electric furnace at 1200 to 1500° C. for 2 hours to obtain powder samples. The average particle diameter of each powder sample was measured. The powder samples consisting of large particles were pulverized in a wet type ball mill using ethanol as a solvent. Thus, the average particle diameters of all the powder samples having respective compositions were adjusted to about 3 μm.

Next, part of each pulverized powder sample was analyzed by X-ray photoelectron spectroscopy (XPS) to obtain a narrow spectrum of C1s. The intensity of the peak derived from carbonate groups in the spectrum (i.e., the peak whose peak top is located around 288 to 290 eV) was integrated to calculate the degree of carbonation. It means that in a compound as a powder sample having a lower degree of carbonation, a smaller amount of carbonates is formed, which imparts better chemical stability to the sample. For comparison, the degree of carbonation of a MgO powder (Sample No. 24) also was measured in the same manner. Table 1 shows the degrees of carbonation measured.

TABLE 1

General formula: $a(M^1O)\bullet SnO_2\bullet b(M^2O_{0.5})$

| No. | Examples & Comparative (Com.) Examples | $M^1$ | $M^2$ | a | b | Degree of carbonation |
|---|---|---|---|---|---|---|
| 1 | Com. Example | Ca | K | 1 | 0 | 516 |
| 2 | Example | | K | 1 | 0.05 | 135 |
| 3 | Com. Example | | K | 2 | 0 | 1664 |
| 4 | Example | | K | 2 | 0.05 | 953 |
| 5 | Com. Example | Sr | K | 1 | 0 | 754 |
| 6 | Example | | K | 1 | 0.05 | 164 |
| 7 | Example | | K | 1 | 0.002 | 382 |
| 8 | Example | | K | 1 | 0.3 | 358 |
| 9 | Example | | Li | 1 | 0.05 | 621 |
| 10 | Example | | Na | 1 | 0.05 | 482 |
| 11 | Com. Example | Ba | K | 1 | 0 | 850 |
| 12 | Example | | K | 1 | 0.002 | 453 |
| 13 | Example | | K | 1 | 0.01 | 397 |
| 14 | Example | | K | 1 | 0.03 | 222 |
| 15 | Example | | K | 1 | 0.05 | 209 |
| 16 | Example | | K | 1 | 0.1 | 265 |
| 17 | Example | | K | 1 | 0.2 | 355 |
| 18 | Example | | K | 1 | 0.3 | 451 |
| 19 | Example | | K | 1 | 0.4 | 875 |
| 20 | Example | | Li | 1 | 0.05 | 642 |
| 21 | Example | | Na | 1 | 0.05 | 515 |
| 22 | Example | | Rb | 1 | 0.05 | 212 |
| 23 | Example | | Cs | 1 | 0.05 | 203 |
| 24 | Reference (MgO) | — | — | — | — | 1011 |

The degrees of carbonation of respective samples obtained by XPS were as follows. Samples No. 1, No. 5 and No. 11 containing no alkali metal had smaller values than the value of Sample No. 24 (MgO). It was found that Samples No. 2, No. 6, and Nos. 12 to 18, in which alkali metals were added to the compositions of Samples No. 1, No. 5, and No. 11, respectively, had extremely low degrees of carbonation compared with those of Samples No. 1, No. 5, and No. 11 of Comparative Examples containing no alkali metal. Accordingly, it was confirmed that the addition of an alkali metal increased the stabilization effect dramatically. It also was confirmed from the degrees of carbonation of Samples Nos. 5 to 23 that a desirable value of b is in the range of 0.002 or more to 0.3 or less. It further was confirmed that any of the alkali metals, Li, Na, K, Rb, and Cs, has the effect of suppressing the formation of carbonates.

In the case of a compound represented by $a(M^1O).SnO_2.b(M^2O_{0.5})$, the value of a basically is 1, 1.5, or 2. As a result of the inventors' studies, however, even a mixture containing two alkaline earth metals like, for example, a mixture having an intermediate composition of $(Sr_{0.5}Ba_{0.5}).SnO_2O_2.0.05(KO_{0.5})$ between those of Sample No. 6 and Sample No. 15, exhibited intermediate properties between those of Sample No. 6 and Sample No. 15. Thus, the stabilization effect was obtained. Presumably, the similar stabilization effect can be obtained in a mixture containing at least two alkaline earth metals at another ratio.

[PDP]

In the present examples, a PDP, to which the electron emitting material with improved chemical stability used in the present invention is applied, is shown. A flat front glass substrate made of soda lime glass with a thickness of about 2.8 mm was prepared. A material of ITO (transparent electrodes) was applied in a predetermined pattern on the surface of the front glass substrate, and then was dried. Subsequently, a silver paste, which was a mixture of silver powder and organic vehicle, was applied in the form of a plurality of lines. Thereafter, the whole front glass substrate was heated and thereby the silver paste was baked to form display electrodes.

The glass paste was applied to the front panel on which the display electrodes had been produced, using the blade coater method. The panel was maintained at 90° C. for 30 minutes so that the glass paste was dried, and then the glass paste was baked at a temperature of 585° C. for 10 minutes. Thus, a dielectric layer with a thickness of about 30 μm was formed.

Magnesium oxide (MgO) was vapor-deposited on the above-described dielectric layer by the electron beam vapor deposition method. Thereafter, it was baked at 500° C. and thereby a protective layer was formed.

About 3 parts by weight of each of the powder samples Nos. 11, 15, and 24 were mixed with 100 parts by weight of ethyl cellulose vehicle, and the resulting mixture was kneaded with a three roll mill to obtain a paste. A thin coating of this paste was applied by the printing method on the protective layer (MgO layer), dried at 90° C., and then baked in air at 500° C. During this process, the density of the paste was adjusted so that about 20% of the baked protective layer was coated with the powder. For comparison, a panel, in which the paste printing was not performed, (i.e., a panel, in which the electron emitting material used in the present invention was not provided), also was produced.

On the other hand, the rear panel was produced by the following method.

First, address electrodes composed mainly of silver were formed in the form of stripes on a rear glass substrate made of soda lime glass, by screen printing. Subsequently, a dielectric layer with a thickness of about 8 μm was formed by the same method as that used for forming the front panel.

Next, a glass paste was used to form barrier ribs between adjacent address electrodes on the dielectric layer. The barrier ribs were formed by repeating screen printing and baking.

Subsequently, phosphor pastes of red (R), green (G), and blue (B) were applied to the wall surfaces of the barrier ribs and the surface of the dielectric layer exposed between the barrier ribs, and then were dried and baked to produce phosphor layers.

The front panel and rear panel thus produced were bonded to each other at 500° C. using a sealing glass. Then, the discharge space was evacuated, and then filled with Xe as a discharge gas and sealed. Thus a PDP was produced.

The panel thus obtained was connected to a driving circuit to cause the panel to emit light. The discharge sustaining voltage of the panel in which MgO powder of Sample No. 24 was spread was reduced by 6% with respect to that of the panel in which the electron emitting material used in the present invention was not provided. In contrast, the discharge sustaining voltages of the panels in which the powders of Samples No. 11 and No. 15 were spread were reduced by 17% and 20% respectively. It was confirmed from these results that the discharge sustaining voltage can be reduced by disposing the electron emitting material containing Sn, an alkali metal, O, and at least one element selected from the group consisting of Ca, Sr, and Ba to face the discharge space, as in the PDP of the present invention.

INDUSTRIAL APPLICABILITY

The present invention can be applied suitably to PDPs that require a further reduction in voltage consumption.

The invention claimed is:

1. A plasma display panel comprising a first panel and a second panel with a discharge space being formed between the first panel and the second panel, wherein an electron emitting material is disposed to face the discharge space, and wherein the electron emitting material is represented by the general formula $a(M^1O).SnO_2.b(M^2O_{0.5})$, where $M^1$ is at least one element selected from the group consisting of Ca, Sr, and Ba, $M^2$ is at least one element selected from the group consisting of Li, Na, K, Rb, and Cs, a value of a is in a range of 1 or more to 2 or less, and a value of b is in a range of 0.002 or more to 0.3 or less.

2. The plasma display panel according to claim 1, wherein the first panel includes a first substrate, a first electrode formed on the first substrate, and a first dielectric layer formed to cover the first electrode, the second panel includes a second substrate, a second electrode formed on the second substrate, a second dielectric layer formed to cover the second electrode, and a phosphor layer, and the electron emitting material is disposed on at least one panel selected from the first panel and the second panel so as to face the discharge space.

3. The plasma display panel according to claim 2, wherein the electron emitting material is disposed in at least one form selected from particles and a film.

4. The plasma display panel according to claim 2, wherein a protective layer is formed on the first dielectric layer.

5. The plasma display panel according to claim 4, wherein the protective layer is made of MgO.

6. The plasma display panel according to claim 4, wherein the electron emitting material is disposed on the protective layer in at least one form selected from particles and a film.

7. The plasma display panel according to claim 4, wherein the protective layer includes the electron emitting material.

* * * * *